US006852213B1

(12) United States Patent
Tong

(10) Patent No.: US 6,852,213 B1
(45) Date of Patent: Feb. 8, 2005

(54) PHOSPHORUS-SULFUR BASED ANTIFOULANTS

(75) Inventor: Youdong Tong, Houston, TX (US)

(73) Assignee: Nalco Energy Services, Sugar Land, TX (US)

( * ) Notice: Subject to any disclaimer, the term of this patent is extended or adjusted under 35 U.S.C. 154(b) by 0 days.

(21) Appl. No.: 09/396,715

(22) Filed: Sep. 15, 1999

(51) Int. Cl.[7] ..... C10G 9/16

(52) U.S. Cl. ..... 208/48 AA; 208/48 R; 208/131; 208/132; 585/648

(58) Field of Search ..... 208/48 AA, 48 R, 208/131, 132; 585/648

(56) References Cited

U.S. PATENT DOCUMENTS

| | | | | |
|---|---|---|---|---|
| 3,647,677 A | | 3/1972 | Wolff et al. | |
| 4,024,048 A | | 5/1977 | Shell et al. | |
| 4,024,049 A | | 5/1977 | Shell et al. | |
| 4,024,051 A | * | 5/1977 | Shell et al. | 208/348 |
| 4,226,700 A | | 10/1980 | Broom | |
| 4,542,253 A | | 9/1985 | Kaplan et al. | |
| 4,842,716 A | * | 6/1989 | Kaplan et al. | 208/48 AA |
| 5,284,994 A | * | 2/1994 | Brown et al. | 585/648 |
| 5,354,450 A | | 10/1994 | Tong et al. | |
| 5,446,229 A | * | 8/1995 | Taylor et al. | 585/648 |
| 5,632,865 A | * | 5/1997 | Stein et al. | 203/6 |
| 5,656,150 A | * | 8/1997 | Reed et al. | 208/48 R |
| 5,779,881 A | | 7/1998 | Tong et al. | |
| 5,863,416 A | * | 1/1999 | Lemke | 208/48 AA |

FOREIGN PATENT DOCUMENTS

| | | |
|---|---|---|
| CA | 1205768 | 6/1986 |

* cited by examiner

*Primary Examiner*—Walter D. Griffin
(74) *Attorney, Agent, or Firm*—Michael B. Martin; Thomas M. Breininger

(57) ABSTRACT

This invention is directed to a method of inhibiting fouling of heat transfer surfaces in contact with petroleum or hydrocarbon feedstocks comprising contacting the heat-transfer surfaces with an effective amount of a thermally-treated phosphorous-sulfur compound and to methods and apparatus for preparing and contacting the thermally-treated phosphorous-sulfur compounds with the heat transfer surfaces.

26 Claims, 7 Drawing Sheets

FIGURE 1. INJECTION APPARATUS, CONVENTIONAL
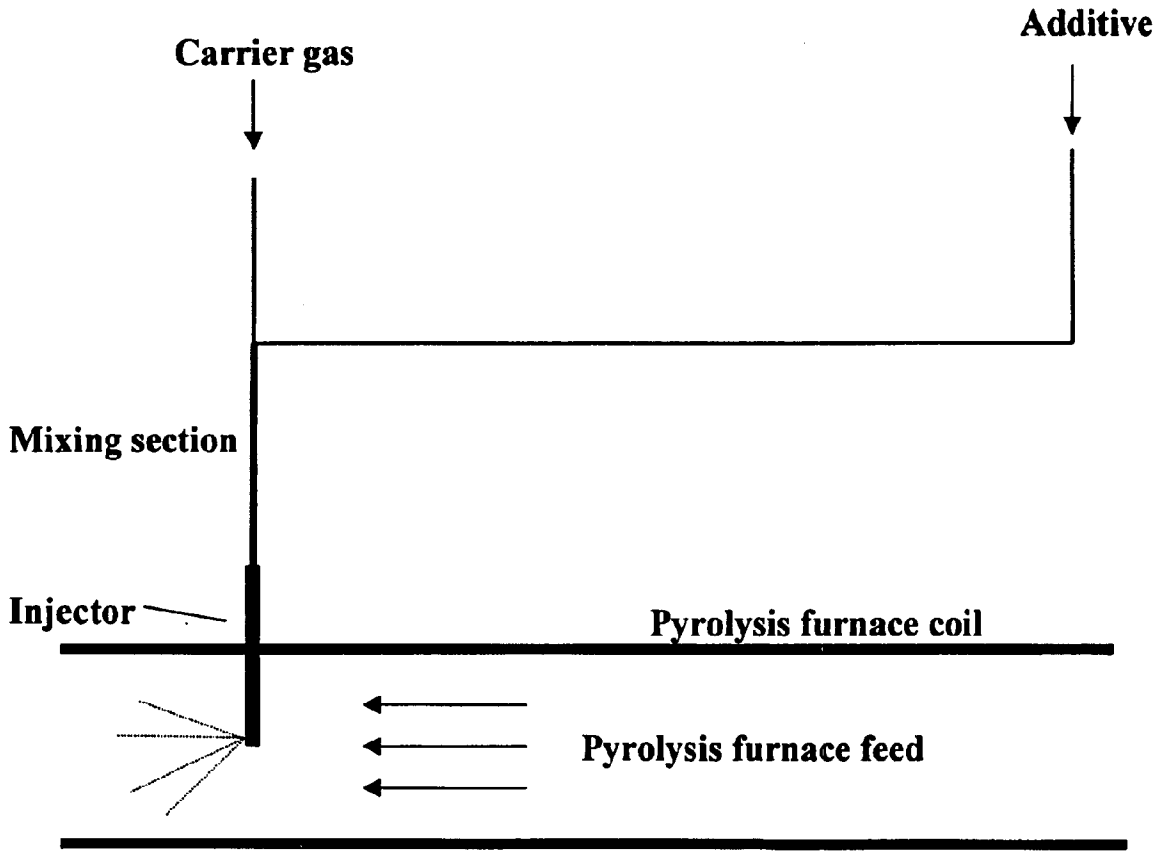

FIGURE 2. INJECTION APPARATUS, CONVENTIONAL
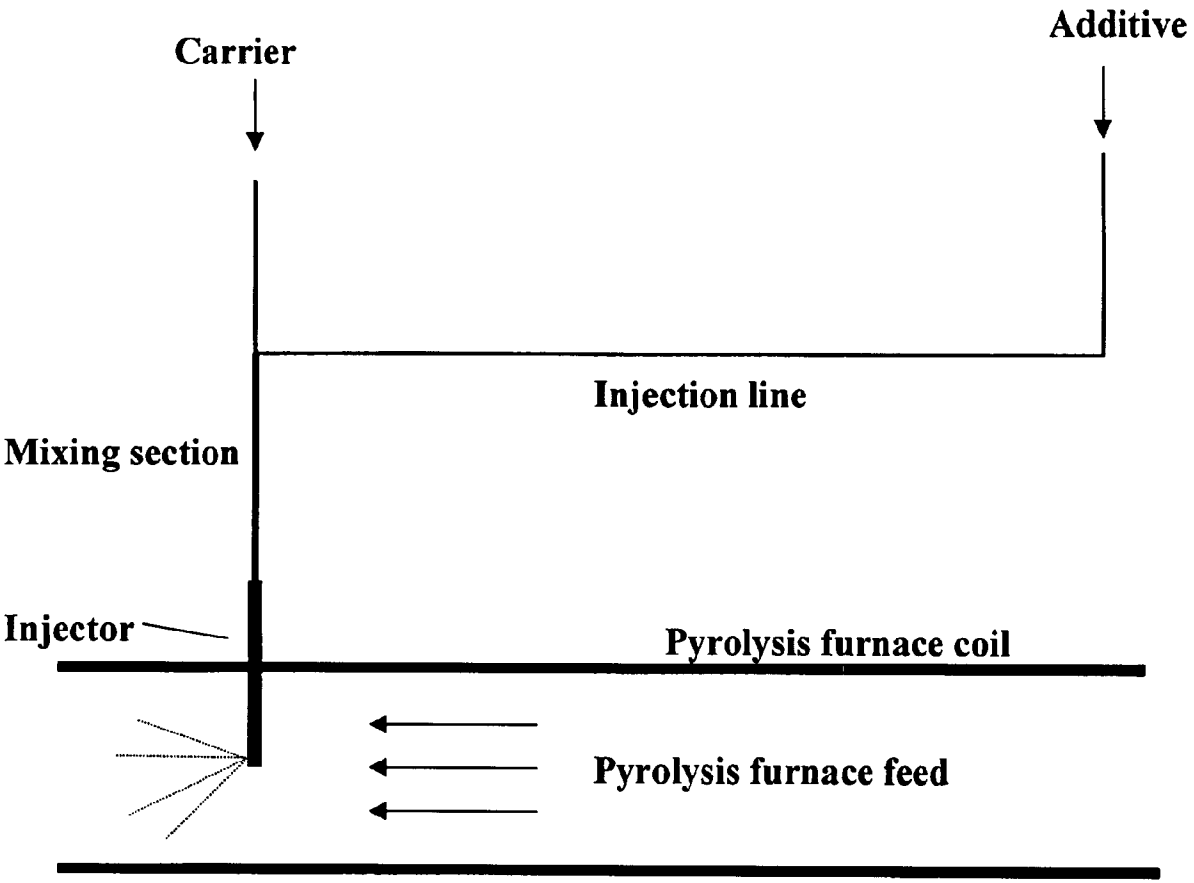

FIGURE 3. INJECTION APPARATUS, COMPRISING A MICROTHERMAL REACTOR
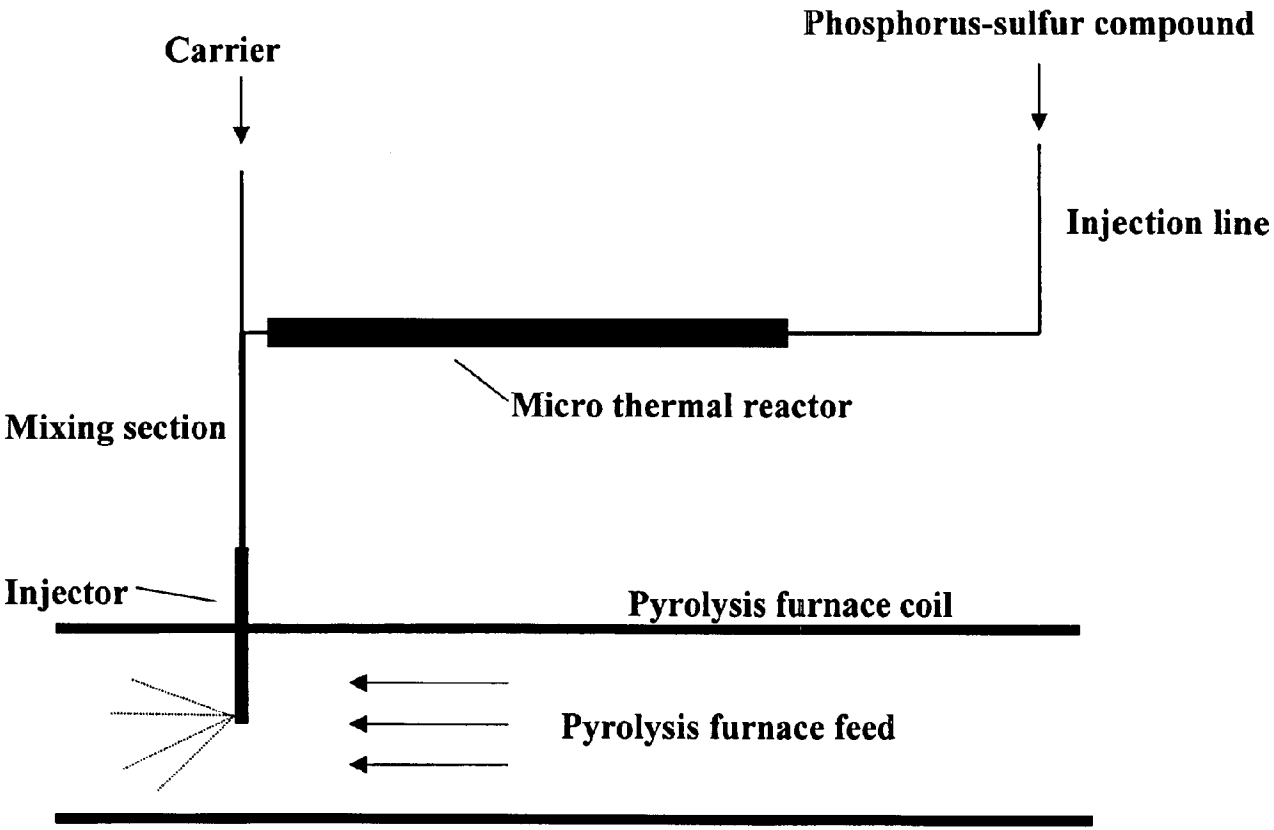

FIGURE 4. INJECTION APPARATUS USIGN STEAM
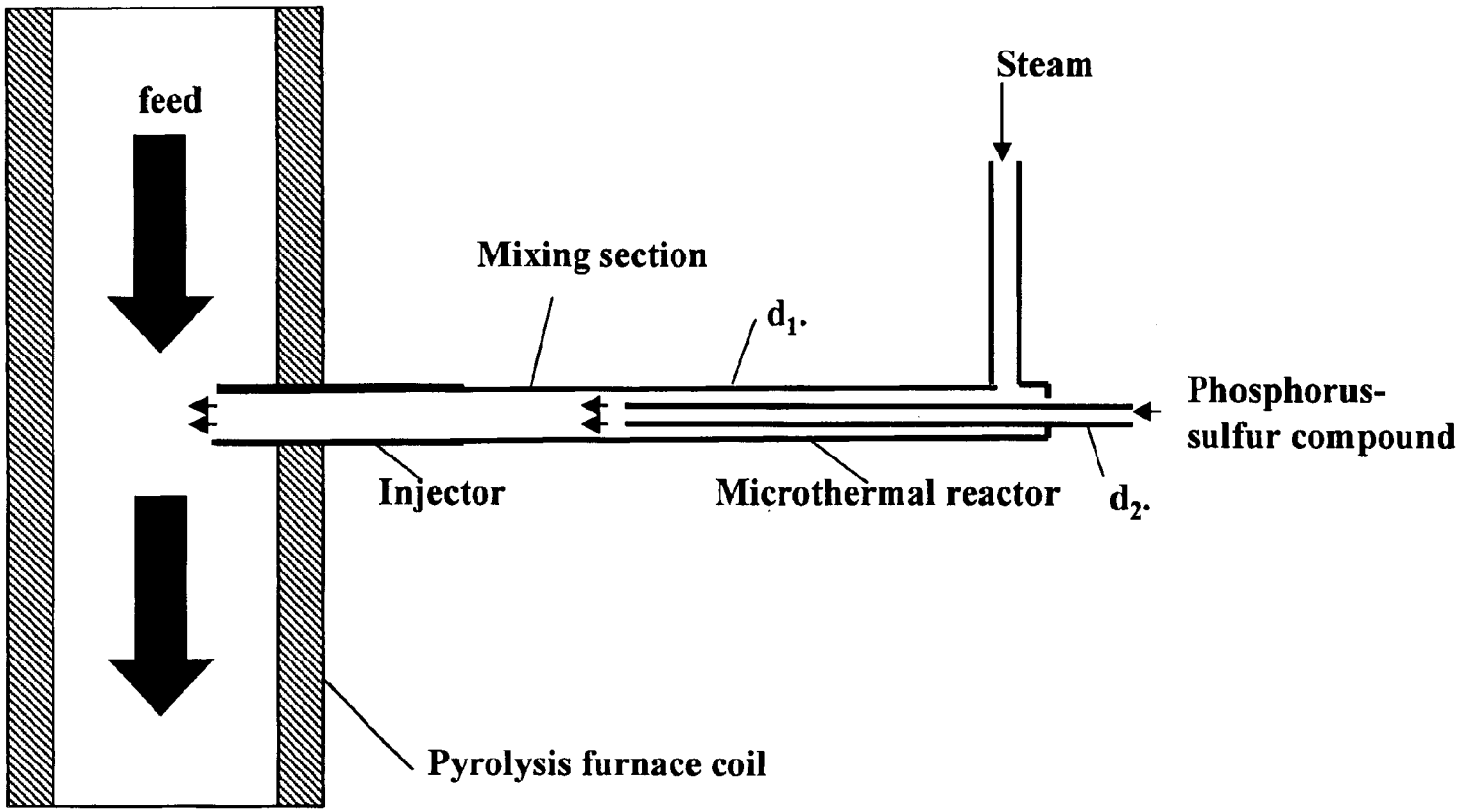

FIGURE 5. INJECTION APPARATUS, FURNACE COIL HEATING
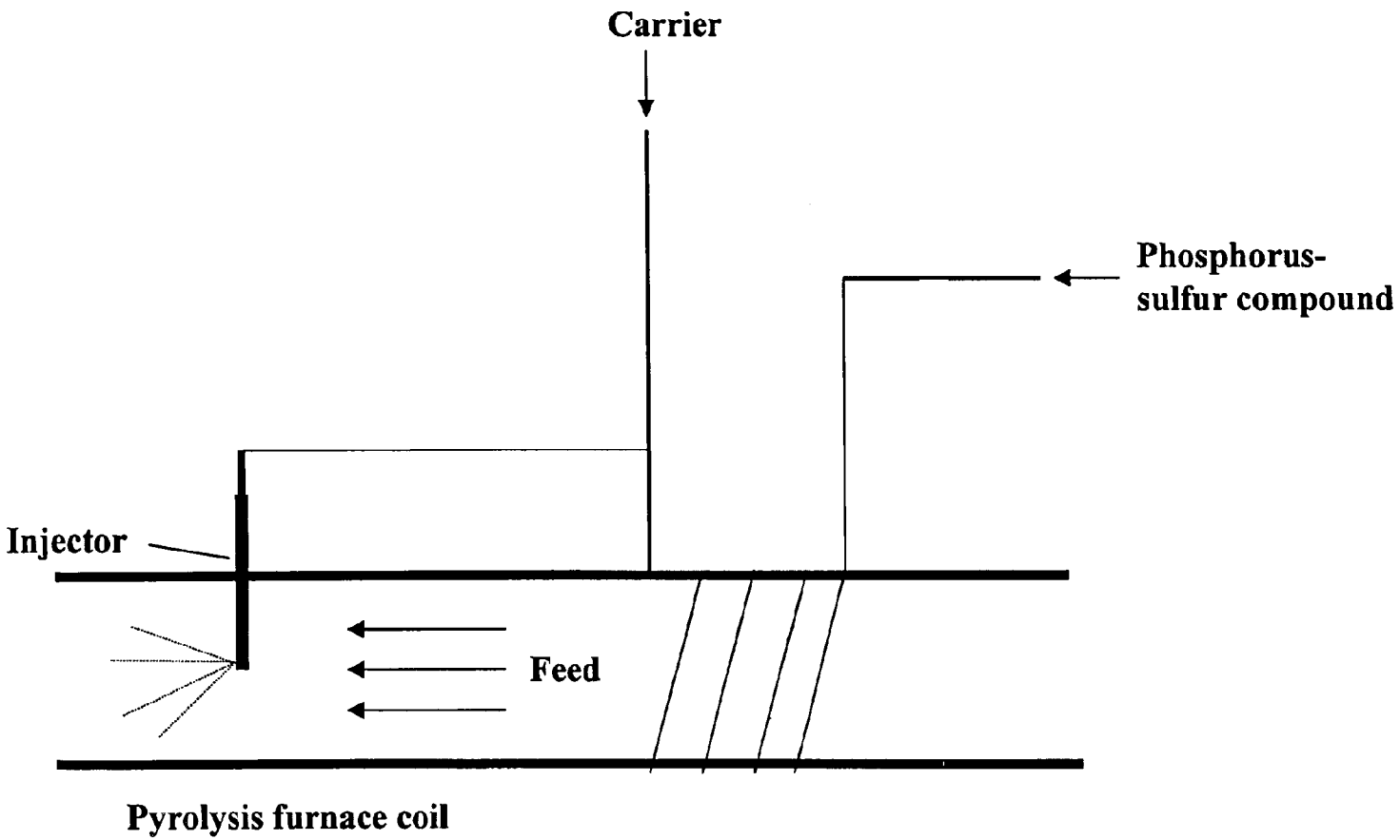

FIGURE 6. INJECTION APPARATUS, FIRE BOX HEATING
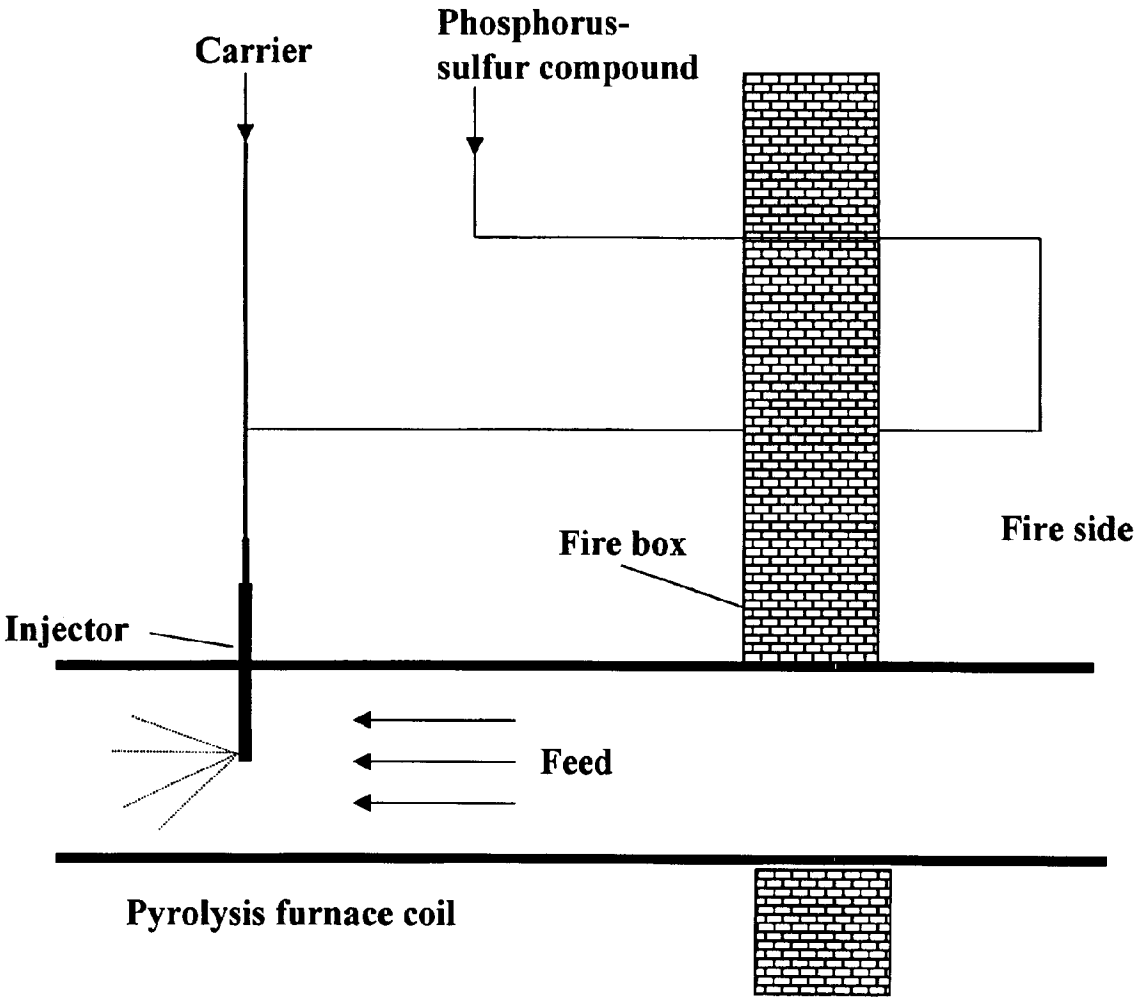

FIGURE 7. INJECTION APPARATUS, ELECTRICAL HEATER
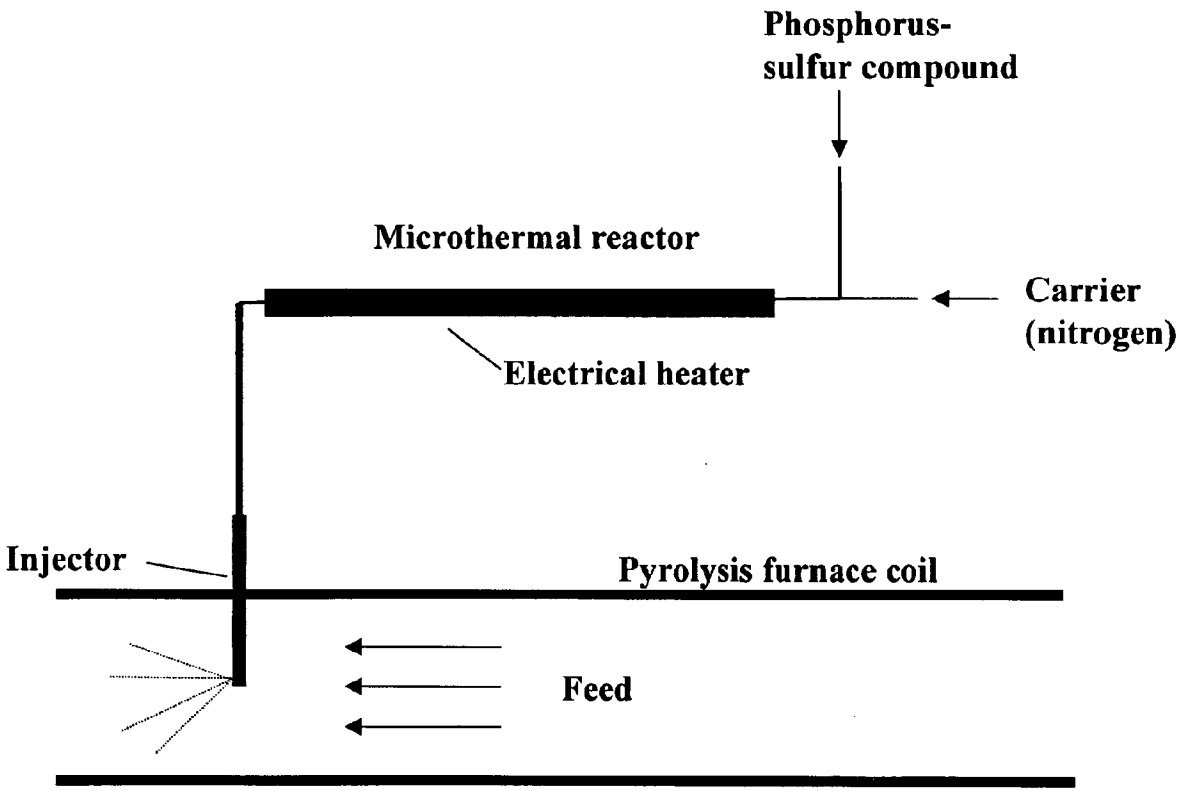

PHOSPHORUS-SULFUR BASED ANTIFOULANTS

TECHNICAL FIELD

This is invention concerns a method of inhibiting fouling of heat transfer surfaces which heat or cool petroleum or hydrocarbon feedstocks using thermally-treated phosphorous-sulfur compounds and methods and apparatus for preparing the compounds and contacting the compounds with the heat transfer surfaces.

BACKGROUND OF THE INVENTION

Fouling of heat transfer surfaces due to coke formation is a significant problem in refinery equipment and pyrolysis furnaces used for the high temperature processing of hydrocarbon feedstocks.

In particular, ethylene manufacture involves the use of pyrolysis furnaces (also known as steam crackers or ethylene furnaces) to thermally crack various gaseous and liquid petroleum feedstocks to ethylene, propylene and other useful products.

A typical pyrolysis furnace has three building blocks: convection section, radiant section, and transfer line exchanger (TLE). Steam is generally injected into the pyrolysis furnace in addition to petroleum feedstocks. The convection section is a heat exchange device to recover exhaust heat and to preheat feed. Petroleum feedstocks and steam are fed into convection section coils, where the petroleum feedstocks and steam are mixed and preheated to desired temperatures ranging from 400 to 700° C. The hot mixture of the petroleum feedstocks and the steam (hereinafter "feed") is then sent to the radiant section. The radiant section is the reactor where the petroleum feedstocks are thermally cracked at temperatures ranging from 700 to 1000° C. The radiant section reactor itself is Ni—Cr—Fe alloy tubes with diameters between 2 to 9 inches. The effluent exits the radiant section at a temperature from 750 to 870° C., and this effluent is immediately discharged to TLE. A TLE is a heat exchanger, and its function is to quickly quench the hot radiant section effluent to about 250° C.

The effluent from TLE is further cooled through oil and/or water quench towers, and then fractionated and purified in the downstream processes to desired products.

Ethylene and propylene are two of the major and the most desired of the products.

Carbonaceous material, known as coke, forms as the by-product of the cracking reactions in pyrolysis furnaces. Fouling of the radiant reactor coils and TLEs occurs due to the coke formation. The coke formation and fouling often becomes the major limitation in pyrolysis furnace operation. The coke formation and fouling decreases the effective cross-sectional area of the process feed flow, and thus increases the pressure drop across pyrolysis furnaces. The pressure buildup in the radiant reactor adversely affects product yield of desired products. Generally, a reduction in feed rate is necessary to compensate for the pressure buildup, resulting in a cut in production. Additionally, coke is a good thermal insulator, and thus the coke buildup inside of a radiant reactor requires a gradual increase in furnace firing to ensure enough heat transfer to maintain the cracking reactions at a desired conversion level. The fouling in TLE's also decreases the effective cross-sectional area of flow, which reduces heat transfer efficiency of the TLE's or causes pressure buildup. Depending on the coking and fouling rate, pyrolysis operation must be periodically shut down for coke removal.

The coke removal from pyrolysis furnaces is carried out using a mixture of steam and air of various steam/air ratios to burn out the coke in the pyrolysis furnaces (decoke). The coke removal from TLEs often requires both the decoke and a subsequent off-line mechanical cleaning. In addition to the periodic cleaning, crash shutdowns are sometimes required because of dangerous situations resulting from coke buildup in the pyrolysis furnaces.

The pyrolysis operation down time, capacity reduction, and ethylene yield deterioration lead to production loss. Coke formation and fouling also stresses pyrolysis operation and shortens pyrolysis furnace lifetime. Therefore, any process improvement or chemical treatment that could reduce coke formation and fouling would increase production and lower maintenance costs.

Coke inhibitors are chemical additives used to treat heat transfer surfaces to prevent coke formation and fouling. Organophosphorus compounds containing phosphorus-sulfur bonding, such as mono- or di-substituted thiophosphate esters, phosphorothioites, phosphorothioates and thiophosphonates, (hereinafter "phosphorus-sulfur compounds") are known antifoulants to prevent coke formation and fouling on heat transfer surfaces of refinery and petrochemical plant equipment.

U.S. Pat. No. 3,647,677 discloses a method of using triethylthiophosphite, as crude oil additive to retard coke formation on refinery equipment. U.S. Pat. No. 4,024,048 discloses a method of treating hydrodesulfurization equipment with phosphate and phosphite mono- and di-thioester antifoulants. U.S. Pat. Nos. 4,024,049 discloses a method of treating the equipment in a crude oil system with thiophosphate and phosphite mono- and di-esters to prevent fouling. U.S. Pat. No. 4,226,700 discloses a method of preventing fouling on refinery equipment using a combination comprising thiodipropionate and phosphate/phosphite diesters/thioesters. U.S. Pat. No. 4,542,253 discloses water soluble amine neutralized mono- and di-substituted thiophosphate esters for reducing fouling and corrosion in ethylene furnaces. Canadian patent No. 1,205,768 discloses morpholine-neutralized phosphate and thiophosphate esters as ethylene furnace anti-coking antifoulants. U.S. Pat. No. 5,354,450 discloses phosphorothioates for inhibiting coke formation in ethylene furnaces. U.S. Pat. No. 5,779,881 discloses phosphonate/thiophosphonate for inhibiting coke formation in ethylene furnaces.

In practice, the injection of the additive generally requires a pump, an injector and an injection line which connects the pump and the injector. An injector is essentially a piece of tubular pipe insertion into a pyrolysis furnace coil, and its function is to transport the additive into pyrolysis coils. The injector can be as simple as a piece of high alloy tubing or as sophisticated as an atomizer. The inlet end of the injector is located outside of the coil and connected to the injection line. The outlet end is located inside of the coil and the additive discharged to the process stream at the outlet end. Carrier gases are often used to facilitate the delivery of the additive and the distribution of the additive in process feed. As indicated above, there is no chemical treatment or preparation of the additive, except physical delivery, during the process of injecting the additive.

SUMMARY OF THE INVENTION

The inventor has discovered that the thermally-treated phosphorus-sulfur compounds described herein are much more effective than conventional phosphorus-sulfur compounds in inhibiting coke formation and fouling on heat transfer surfaces.

Accordingly, in its principle aspect, this invention is directed to a method of inhibiting fouling of heat transfer surfaces in contact with petroleum or hydrocarbon feedstocks comprising contacting the heat transfer surfaces with an effective amount of a thermally-treated phosphorous-sulfur compound.

In another aspect, this invention is directed to a method of injecting a thermally-treated phosphorus-sulfur compound into a pyrolysis furnace coil comprising pumping a phosphorus-sulfur compound through a microthermal reactor, wherein the microthermal reactor is heated such that the effluent from the microthermal reactor comprises thermally-treated phosphorous-sulfur compound, and injecting the thermally-treated phosphorous-sulfur compound into the pyrolysis furnace coil.

In another aspect, this invention is directed to an apparatus for injecting a thermally-treated phosphorus-sulfur compound into a pyrolysis furnace coil comprising means for pumping a phosphorus-sulfur compound through a microthermal reactor in which the phosphorous-sulfur compound is converted to the thermally-treated phosphorous-sulfur compound and means for introducing the thermally-treated phosphorous-sulfur compound effluent from the microthermal reactor into the pyrolysis furnace coil.

BRIEF DESCRIPTION OF THE DRAWINGS

FIG. 1 shows the coke formation on three individual coupons. In FIG. 1, "a" represents the untreated coupon; "b" represents a coupon treated with s,s,s-tributyl phosphorothioate; and "c" represents a coupon treated with the thermally-treated s,s,s-tributyl phosphorothioate.

FIG. 2 shows a conventional pyrolysis furnace injector apparatus. An additive flows through the injection line to the mixing section where it is mixed with a carrier. The additive/carrier mixture is then conveyed through the injector into the process stream in the pyrolysis coil.

FIG. 3 shows the injection apparatus of this invention in which a conventional pyrolysis furnace injector apparatus is modified to incorporate a microthermal reactor. The phosphorous-sulfur compound flows through the injection line into the microthermal reactor where thermal conversion to the thermally-treated phosphorous-sulfur compound occurs. The effluent from the microthermal reactor is then mixed with a carrier in the mixing section. The thermally-treated phosphorous-sulfur compound/carrier mixture is then conveyed through the injector into the process stream in the pyrolysis coil.

FIG. 4 shows the injector apparatus of this invention which uses steam as the heating media for the microthermal reactor and also as the carrier. The phosphorous-sulfur compound flows through the inner tube d1, and steam flows through the annular space between the inner tube d1 and the outer tube d2. The phosphorous-sulfur compound is heated by the steam while both of them move down the line. At the end of the inner tube, the steam and the thermally-treated phosphorous-sulfur compound effluent from the heating section meet and mix, and the steam serves as carrier thereafter. The thermally-treated phosphorous-sulfur compound/steam mixture proceeds through the injector. At the exit of the injector, the thermally-treated phosphorous-sulfur compound/steam mixture contacts the feed in the pyrolysis furnace coil and is dispersed in the feed.

FIG. 5 shows the injector apparatus of this invention which uses a pyrolysis furnace coil as the heating device. In this case, the microthermal reactor is a piece of high alloy tubing which wraps around a hot pyrolysis furnace coil. The phosphorous-sulfur compound is heated using the heat from the pyrolysis furnace coil. After heating, the thermally-treated phosphorous-sulfur compound is mixed with a carrier and the thermally-treated phosphorous-sulfur compound/carrier mixture flows through the injector and discharges into the pyrolysis furnace, contacting with the feed in the pyrolysis furnace coil.

FIG. 6 shows the injector apparatus of this invention which uses a pyrolysis furnace fire box as the heating device. The microthermal reactor is a piece of high alloy tubing which is located inside the fire box of a pyrolysis furnace. The phosphorous-sulfur compound is heated when it flows through the tubing, and then it is mixed with a carrier. After the mixing, the thermally-treated phosphorous-sulfur/carrier mixture flows through the injector and discharges into the pyrolysis furnace.

FIG. 7 shows the injector apparatus of this invention which uses an electrical heater as the heating device. The phosphorous-sulfur compound and carrier are fed in through different lines, and they mix. The phosphorous-sulfur compound/carrier mixture is heated up in a microthermal reactor comprising a tube which is heated by an electrical heater. After heating, the thermally-treated phosphorous-sulfur compound/carrier mixture flows through the injector and contacts the feed in the pyrolysis furnace coil.

DETAILED DESCRIPTION OF THE INVENTION

Definitions of Terms

As used herein the following terms shall have the following meanings.

"Phosphorus-sulfur compound" means an organophosphorus compound which contains one or more phosphorus-sulfur bonds such as P—S or P═S and which are suitable for thermal conversion to a thermally-converted phosphorous-sulfur compound as defined herein. Representative phosphorous-sulfur compounds include mono- or di-substituted thiophosphate esters, phosphorothioites, phosphorothioates, thiophosphonates, and the like.

"Thermally-treated phosphorous sulfur compound" means the material resulting from thermal treatment of a phosphorous-sulfur compound as defined herein under the conditions described herein. The thermally-treated phosphorous sulfur compound is characterized by a $^{31}P$ NMR chemical shift 93–97 ppm which forms at the expense of the corresponding starting conventional phosphorus-sulfur compound $^{31}P$ resonance and a strong IR bend at around 687 $cm^{-1}$.

"Heat transfer surface" means the hydrocarbon stream-contacting surfaces of equipment used to heat or cool the hydrocarbon streams. Representative heat transfer surfaces are included in the radiant section and TLE of pyrolysis furnaces as well as in oil and/or water quench towers.

"Mono- or di-substituted thiophosphate ester" means a compound of formula $(RO)_aPS(SX)_b$, wherein X is hydrogen or neutralizing amine, R is alkyl, aryl, alkylaryl or arylalkyl and a and b are independently 1 or 2, provided that $a+b=3$. Representative mono- and disubstituted thiophosphate esters include (ethyl)hexyl thiophosphate ester and di(ethyl)hexyl thiophosphate ester, where (ethyl)hexyl means an n-hexyl group substituted by ethyl such as 2-ethylhexyl, octyl thiophosphate ester, butyl thiophosphate ester, nonylphenyl thiophosphate ester, phenyl thiophosphate ester, t-butylphenyl thiophosphate ester, benzyl thiophosphate ester, butyl phenyl thiophosphate ester, (ethyl)

hexyl phenyl thiophosphate ester, octyl benzyl thiophosphate ester, and the like.

"Neutralizing amine" means an amine which is used to neutralize the acidic —SH group in mono- and disubstituted thiophosphate esters as defined herein where X is H. Representative neutralizing amines include $C_{12}$–$C_{14}$ primary and secondary alkyl amines and cyclic amines such as morpholine.

"Phosphorothioite" means a compound of formula $(R^1Y^1)_C\ P(Y^2R^2)_d$, where $R^1$ and $R^2$ are independently alkyl, aryl, alkylaryl or arylalkyl or the like or when c or d is 2 or 3, any 2 $R^1$ or $R^2$ taken together may form heterocyclyl; $Y^1$ and $Y^2$ are independently oxygen or sulfur, provided that at least one of $Y^1$ and $Y^2$ is sulfur; and c and d are independently 0, 1, 2 or 3, provided that $c+d=3$. Representative phosphorothioites include s,s,s-tributyl phosphorothioite, s,s,s-triphenyl phosphorothioite, o-ethyl, s,s-dipropyl phosphorothioite, o-ethylhexyl, s,s-butyl phosphorothioite, and the like.

"Phosphorothioate" means a compound of formula $(R^1Y^1)_aPZ(Y^2R^2)_b$, wherein Z is oxygen or sulfur and $Y^1$, $Y^2$, $R^1$, $R^2$, a and b are defined above, provided that at least one of $Y^1$, $Y^2$ and Z is sulfur. Representative phosphorothioates include s,s,s-tributyl phosphorothioate, s,s,s-triphenyl phosphorothioate, o-ethyl, s,s-dipropyl phosphorothioate, o-ethylhexyl, s,s-butyl phosphorothioate, o,o-ethylhexyl, s-butyl, phosphorothioate, o,o,o-triethyl phosphorothioate, o,o,o-triphenyl phosphorothioate, and the like.

"Thiophosphonate" means a compound of formula of $(R^1Y^1)_2P(Z)R^2$, wherein $R^1$, $R^2$, Z and $Y^1$ are defined above. Representative thiophosphonates include s,s-ethylhexyl ethylhexykl dithiophosphonate, o-ethylhexyl, s-butyl, thiophosphonate, and the like.

"Alkyl" means a monovalent group derived from a straight or branched chain saturated hydrocarbon having from 1 to about 30 carbon atoms by the removal of a single hydrogen atom. Preferred alkyl have from 3 to about 15 carbon atoms. Representative alkyl groups include ethyl, n- and iso-propyl, n-, sec-, iso- and tert-butyl, and the like.

"Alkylene" means a divalent group derived from a straight or branched chain saturated hydrocarbon having from 1 to about 30 carbon atoms by the removal of two hydrogen atoms. Preferred alkyl have from 3 to about 15 carbon atoms. Representative alkylene groups include methylene, ethylene, propylene, isobutylene, and the like.

"Amino" means a group of formula $Y^2Y^3N$— where $Y^2$ and $Y^3$ are independently hydrogen, alkyl, aryl, heterocyclyl or arylalkyl as defined herein. Representative amino groups include amino (—$NH_2$), methylamino, ethylamino, isopropylamino, dimethylamino, diethylamino, methylethylamino, piperidino, and the like.

"Aryl" means an aromatic monocyclic or multicyclic ring system of about 6 to about 20 carbon atoms, preferably of about 6 to about 10 carbon atoms. The aryl is optionally substituted with one or more hydroxy, alkoxy, amino or thio groups. Representative aryl groups include phenyl or naphthyl, or substituted phenyl or substituted naphthyl.

"Arylene"means an aromatic monocyclic or multicyclic ring system derived from an aryl as defined herein by the removal of two hydrogen atoms.

"Arylalkyl" means an aryl-allylene- group wherein aryl and alkylene are defined herein. Representative arylalkyl include benzyl, phenylethyl, phenylpropyl, 1-naphthylmethyl, and the like.

"Alkylaryl" means an alkyl-arylene- group where alkyl and arylene are defined herein. Representative alkylaryl include tolyl, ethylphenyl, propylphenyl, nonylphenyl, and the like.

"Heterocyclyl" means an aromatic or non-aromatic monocyclic or multicyclic ring system of about 3 to about 10 ring atoms, preferably about 5 to about 10 ring atoms, in which one or more of the atoms in the ring system is/are element(s) other than carbon, for example nitrogen, oxygen or sulfur. Preferred ring sizes of rings of the ring system include about 5 to about 6 ring atoms. The heterocyclyl is optionally substituted by one or more hydroxy, alkoxy, amino or thio groups. Representative saturated heterocyclyl rings include piperidyl, pyrrolidinyl, piperazinyl, morpholinyl, thiomorpholinyl, and the like. Representative aromatic heterocyclyl rings include pyrazinyl, pyridyl, pyrimidinyl, isoxazolyl, isothiazolyl, pyrazolyl, pyrrolyl, pyrazolyl, triazolyl, and the like.

Preferred Embodiments

In a preferred embodiment, this invention is directed to a method of inhibiting coke formation in pyrolysis furnaces during thermal cracking of hydrocarbon feedstock comprising injecting an effective amount of a thermally-treated phosphorous-sulfur compound into the pyrolysis furnace. The thermally-treated phosphorus-sulfur compound is characterized by a major $^{31}P$ NMR resonance at 93–97 ppm an IR bend at about 687 $cm^{-1}$.

Generally, from about 1 to about 1000 ppm and preferably from about 10 to about 100 ppm of the thermally-treated phosphorus-sulfur compound is injected into the pyrolysis furnace.

The thermally-treated phosphorous-sulfur compound is prepared by heating a phosphorous-sulfur compound as defined herein at a temperature of from about 160 to 500° C. over a few seconds to a few hours. The degree of conversion of the phosphorous-sulfur compound starting material to the thermally-treated phosphorous-sulfur compound is monitored by measuring the appearance over time of the $^{31}P$ NMR resonance at about 93–97 ppm at the expense of the starting material $^{31}P$ NMR resonance(s).

Higher treatment temperatures lead to faster conversion rates, and thus, less time is required for a given degree of conversion at higher temperatures. It is understood that when the thermally-treated phosphorous-sulfur compound is prepared in a batch process conversion times of up to several hours at lower temperatures are contemplated while when the thermally-treated phosphorous-sulfur compound is prepared on-line using the apparatus described herein, conversion times are generally from a few seconds to a few minutes, thereby requiring higher temperatures.

For on-line conversion, the temperature of the microthermal reactor is preferably such that the material exits the microthermal reactor at a temperature of about 200 to 500° C.

In a batch process, thermal conversion is preferably accomplished at from about 180 to about 280° C. and more preferably at from about 200 to 260° C. Preferred conversion times are from about 30 minutes to about 2 hours. The thermal conversion is preferably conducted in an oxygen and water-free environment, such as an inert gas atmosphere. Solvent is not necessary if the conventional phosphorus-sulfur compound is a liquid. If a solvent is used, hydrocarbon solvents with high boiling points are preferred.

Preferred, phosphorus-sulfur compound starting materials are selected from mono- or di-substituted thiophosphate esters, phosphorothioites, phosphorothioates and thiophosphonates.

More preferred the phosphorus-sulfur compound starting materials are trisubstituted phosphorothioates.

Other more preferred phosphorous-sulfur compound starting materials are mono- and di-substituted thiophoshate esters.

Still more preferred phosphorus-sulfur compound starting materials are s,s,s-trialkyl phosphorothioates.

Other still more preferred phosphorous-sulfur compound starting materials are mono- or di-alkyl thiophosphate esters.

Still yet more preferred phosphorous-sulfur compound starting materials are s,s,s-tributyl phosphorothioate, (ethyl) hexyl thiophosphate esters and octyl thiophosphate esters.

The thermally-treated phosphorus-sulfur compounds are used to treat heat transfer surfaces used to heat or cool a petroleum feedstock under fouling conditions such as the coke formation and fouling in pyrolysis furnaces. The heat transfer surfaces are brought in contact with the thermally-treated phosphorus-sulfur compounds using pretreatment or continuous treatment methods or a combination thereof "Pretreatment" means treatment prior to processing (heating or cooling) of the petroleum feedstocks. The pretreatment is done on-line or off-line. One of the off-line pretreatment methods is to wet heat transfer surfaces with the thermally-treated phosphorus-sulfur compounds.

"Continuous treatment" means that the thermally-treated phosphorus-sulfur compounds are added during processing of petroleum feedstocks.

In a preferred aspect of the foregoing, the thermally-treated phosphorous-sulfur compound is injected into the pyrolysis furnace prior to processing the hydrocarbon feedstock.

In another preferred aspect of the foregoing, the thermally-treated phosphorous-sulfur compound is injected into the pyrolysis furnace from about 30 minutes to about 24 hours prior to processing the hydrocarbon feedstock.

In another preferred aspect of the foregoing, the thermally-treated phosphorous-sulfur compound is injected into the pyrolysis furnace simultaneously with hydrocarbon feedstock.

In another preferred aspect, this invention is directed to a method of injecting the thermally-treated phosphorous-sulfur compounds into a pyrolysis furnace coil, thereby providing a practical method of transforming the phosphorus-sulfur compounds to the more active thermally-treated phosphorous-sulfur compounds on-line and at use, resulting in elimination the expense and inconvenience associated with any off-site and off-line conversion, handling, storage and transportation of the thermally-treated phosphorous-sulfur compounds.

In general, this injection method comprises pumping a phosphorous-sulfur compound through an injection line into a microthermal reactor at a controlled rate such that the desired degree of conversion of the phosphorous-sulfur compound to the thermally-treated phosphorus-sulfur compound occurs within the microthermal reactor. Preferably, the microthermal reactor is heated such that the thermally-treated phosphorous-sulfur compound exits the reactor at a temperature of about 200 to about 500° C. The thermally-treated phosphorous-sulfur compound exiting the microthermal reactor is then delivered to an injector which is mounted on a pyrolysis furnace coil. The thermally-treated phosphorous-sulfur compound enters the injector inlet, and exits the injector outlet into the pyrolysis furnace coil. The thermally-treated phosphorous-sulfur compound disperses in the feed in the pyrolysis furnace coil where it contacts the pyrolysis coil inner surfaces. The coke formation and fouling on the pyrolysis coil surfaces is substantially reduced.

In a more preferred aspect, the phosphorous-sulfur compound or the thermally-treated phosphorous sulfur compound is mixed with a carrier in a mixing section which may be situated along the line which conveys the phosphorous-sulfur compound into the microthermal reactor or between the microthermal reactor and the injector inlet.

When the mixing section is located along the line which conveys the phosphorous-sulfur compound into the microthermal reactor, mixing of the phosphorous sulfur compound with the carrier results in formation of a phosphorous-sulfur compound/carrier mixture which is pumped through the microthermal reactor and thermally converted to a thermally-treated phosphorous-sulfur compound/carrier mixture.

When the mixing section is located between the microthermal reactor and the injector inlet, the thermally-treated phosphorous-sulfur compound effluent from the microthermal reactor is mixed with the carrier resulting in formation of the thermally-treated phosphorous-sulfur compound/carrier mixture. The thermally-treated phosphorous-sulfur compound/carrier mixture is then injected into the pyrolysis furnace coil as described above.

Representative carriers include steam, inert gases such as nitrogen, natural gas and hydrocarbons (vapor or liquid).

A preferred carrier is inert gas.

Another preferred carrier is natural gas.

A more preferred carrier is nitrogen.

A still more preferred carrier is steam due to its availability and its potential as heating source for the heating device.

In another aspect, this invention is directed to an apparatus for injecting the thermally-treated phosphorous-sulfur compounds into a pyrolysis furnace coil.

The injection apparatus consists of a pump skid (pumps and coke inhibitor reservoir container), an injection line, a microthermal reactor and an injector. The injection line and injector are similar to those used in current industry practice.

According to this aspect of the invention, the microthermal reactor is added to a conventional injection apparatus on a pyrolysis furnace. The microthermal reactor is essentially a continuous flow reactor such as a tube or cylinder equipped with a heating device. When the phosphorous-sulfur compound flows through the microthermal reactor, it is heated by the heating device to a temperature such that the desired degree of conversion to the thermally-treated phosphorous-sulfur compound occurs, thereby allowing for continuous, on-line conversion of the phosphorus-sulfur compound to the thermally-treated phosphorous-sulfur compound prior to feeding into the pyrolysis furnace.

In a more preferred injection apparatus, a mixing section may be located along the injection line which conveys the phosphorous-sulfur compound into the microthermal reactor or between the microthermal reactor and the injector as described above. The mixing section is similar to those used in current industry practice. In the mixing section, the phosphorous-sulfur compound or the thermally-treated phosphorous-sulfur compound is mixed with a carrier. The carrier facilitates delivery of the phosphorous-sulfur compound into the microthermal reactor and/or delivery of the thermally-treated phosphorous-sulfur compound into the injector.

A conventional injection apparatus comprising an injection line, mixing section and injector is shown in FIG. 2.

A preferred injection apparatus according to this invention comprising an injection line, microthermal reactor, mixing section and injector is shown in FIG. 3.

A preferred heating device is the pyrolysis coils at the crossover from convection to radiant sections of a pyrolysis furnace as shown in FIG. 5.

Another preferred heating device is the fire box of a pyrolysis furnace as shown in FIG. 6.

Another preferred heating device is an electrical heater as shown in FIG. 7.

In a more preferred aspect of the foregoing, the microthermal reactor is heated by steam as shown in FIG. 4.

The foregoing may be better understood by the following Examples, which are presented for purposes of illustration and are not intended to limit the scope of the invention.

Example 1–7 illustrate the thermal conversion of phosphorous-sulfur compounds to thermally-treated phosphorous compounds. Examples 8–11 illustrate methods and apparatus for converting phosphorous-sulfur compounds to thermally-treated phosphorous-sulfur compounds on-site and at-use.

EXAMPLE 1

This illustrates the thermal conversion of a conventional phosphorus-sulfur compound.

Liquid s,s,s-tributyl phosphorothioate, $(C_4H_9S)_3PO$, is fed through a piece of stainless steel tube running through an electrical furnace maintained at around 530° C. The residence time of the liquid in the heated zone of the furnace is around 5 seconds. The vapor at the tube exit is condensed, and analyzed by $^{31}P$ NMR. The starting material s,s,s-tributyl phosphorothioate has a chemical shift of about 65 ppm, while a major chemical shift at 94 ppm is observed for the collected condensate, indicating that the thermal treatment induced chemical changes on the starting material.

EXAMPLE 2

This example illustrates the thermal conversion of a mixture of conventional phosphorus-sulfur compounds.

A mixture of mono- and di-octyl thiophosphate esters is fed through a piece of alloy tube (Incoloy 800) running through an electrical furnace. The temperature at the exit of the tube is around 400° C. The residence time of the mixture in the heated zone of this furnace is less than 5 seconds. The vapor at the tube exit is condensed, and the liquid condensate is analyzed by $^{31}P$ NMR. The starting material has a chemical shift of 110.5, while two major chemical shifts are seen at 96.5 and 58.6 for the thermally-treated finish product in addition to the chemical shift at 110.5 ppm. It is evident that the heat treatment induced chemical changes on the starting materials.

EXAMPLE 3

This example illustrates the preparation of conventional thiophosphate esters and their thermal conversion to the thermally-treated phosphorous-sulfur compounds.

A conventional thiophosphate ester is prepared by reacting phosphorous pentasulfide with alcohol. 224 g of isooctanol is added in a 500 ml 4-neck flask. The flask is continuously purged with nitrogen. The alcohol solution is heated up to 85° C., and then 102 g of $P_4S_{10}$ is gradually added to the alcohol solution with constant stirring. The reaction mixture is heated at 120° C. for 1.5 hours and then at 135° C. for 1.5 hours. A clear light-yellow solution is obtained. The product from this preparation has a major $^{31}P$ NMR shift at around 86 ppm, which is a characteristic $^{31}P$ NMR peak for conventional thiophosphate esters. Thus, the product from this synthesis is an octyl thiophosphate ester.

The thermal conversion of the octyl thiophosphate ester is conducted simply by refluxing the thiophosphate ester at 200° C. for about 1.5 hours. At the end of the reflux, a sample of the product is analyzed by $^{31}P$ NMR. The major chemical shift of this product is at 93.8 ppm, which accounts for about 88% of the total phosphorus species in the product. This chemical shift had a shoulder at 94.7, which accounts for about 10% of the total phosphorus. These two $^{31}P$ NMR chemical shifts, 93.8 ppm and 94.7 ppm, characterize the thermal conversion products from the conventional octyl thiophosphate ester.

Differential scanning calorimetery (DSC) analysis is performed to confirm the thermal conversion process. The conventional octyl thiophosphate and its thermal conversion product are analyzed using DSC. The temperature profile for the analysis starts at 50° C. and ramps up to 320° C. at 10° C./min. The sample is maintained under a nitrogen atmosphere during the analysis. For the conventional octyl thiophoshate ester, an exotherm is observed with an onset temperature around 239° C., whereas no exotherm is seen for the thermal conversion product up to 320° C. The analysis suggests changes in chemical bonding during the thermal conversion process.

EXAMPLE 4

This illustrates an alternative preparation of thermally-treated phosphorous-sulfur compounds from s,s,s-tributylphosphorothioate.

A flask containing about 150 grams of s,s,s-tributyl phosphorothioate is continuously purged with nitrogen. The liquid starting material is heated to 220° C., and maintained at 220° C. for 70 minutes. A sample of the thermally-treated material is analyzed by $^{31}P$ NMR. The $^{31}P$ NMR analysis shows that 45% of the starting material is converted. Two of the major products are characterized by chemical shifts at 94 and 118 ppm.

EXAMPLE 5

This example illustrates an improved thermal conversion of s,s,s-tributylphosphorothioate at a higher treatment temperature compared to Example 4.

A flask containing about 200 grams of s,s,s-tributyl phosphorothioate is continuously purged with nitrogen. The liquid starting material is heated to 240° C., and maintained at 240° C. for 70 minutes. A sample of the treated material is analyzed by $^{31}P$ NMR. The $^{31}P$ NMR analysis shows that 89% of the starting material had been converted. Two of the major products are characterized by chemical shifts at 94 and 118 ppm. Infrared Spectroscopy (IR) of the starting and thermally-converted material reveals that the starting material has a pair of strong bends at 1202 and 1230 $cm^{-1}$, whereas the thermally-converted material did not have these strong bends, and instead has a strong bend at 687 $cm^{-1}$.

EXAMPLE 6

This example illustrates an improved thermal conversion of s,s,s-tributylphosphorothioate at a higher treatment temperature compared to Example 5.

To a flask containing about 150 grams of s,s,s-tributyl phosphorothioate is continuously purged with nitrogen. The liquid starting material is heated to 220° C., maintained at 220° C. for 70 minutes, further increased to 250° C., and maintained at 250° C. for 60 minutes. A sample of the thermally-treated material is analyzed by $^{31}P$ NMR. The $^{31}P$ NMR analysis shows that the starting material is completely converted (nothing is detected at chemical shift 64 ppm). The major product is characterized by a chemical shift at 94 ppm.

EXAMPLE 7

This example illustrates the effectiveness of the thermally-treated phosphorus-sulfur compounds as a coke inhibitor in comparison to the conventional phosphorus-sulfur compounds.

The coke inhibition effectiveness tests involve the utilization of a bench-scale laboratory test unit which simulates the operations in a pyrolysis furnace. The furnace reactor of this simulation unit consists of a stainless steel coil preheater (convection section), a quartz tube reactor (radiant section) and an electrobalance. A test coupon of Incoloy 800 alloy is suspended in the radiant section of the furnace reactor, and its weight is constantly recorded by the electrobalance. The weight increase during a cracking operation is a measure of coke deposition on the metal coupon. The typical output from the electrobalance is a plot of coke buildup vs. time on stream. Two pieces of information from the plot is total coke accumulation within a time period and coking rate at each individual moment. The coking rate is a measure of coke accumulation per unit time at a given moment, which is measured by the slope of the coke-time curve at that moment. Thus, the steeper the slope is, the higher the coking rate.

During a cracking operation, heptane and steam are fed into the pyrolysis unit. The steam to heptane weight ratio is maintained around 0.4. The residence time is about 0.3 second for the cracking reaction zone in the radiant section of the unit.

The effectiveness of a coke inhibitor is determined by two different types of tests. In the first test, a metal coupon is treated by soaking in the testing coke inhibitor for 30 minutes prior to installing in the furnace reactor. The treated coupon is heated up to 150° C. in a mixing flow of hydrogen and helium and maintained at 150° C. for about one hour to dry the coupon. The coupon is then further heated up to about 750° C. in a mixing flow of steam, nitrogen, and helium. Coke formation on the treated coupon is then recorded with this coupon through a cracking nun. The coke formation on three individual coupons was noted: untreated (a), treated with s,s,s-tributyl phosphorothioate (b), and treated with the thermally-treated s,s,s-tributyl phosphorothioate. A marginal reduction in coke accumulation is seen with the s,s,s,-tributyl phosphorothioate treatment compared to the blank, while a significant reduction in both coke accumulation and coking rate is observed with the thermally-treated s,s,s-tributyl phosphorothioate.

In the second test, the hydrocarbon feedstock is a heptane solution containing, 50 part per million in weight (ppmw) of dimethyl disulfide. Coke inhibitors are dosed in the feedstock solution, and then the feedstocks are tested for their coking tendency. The coking tendency is determined by the coking rate at the end of a two-hour cracking run (refer as asymptotic coking rate). Table 1 lists the asymptotic coking rates for two feedstocks: the feedstock containing no coke inhibitor, and the feedstock dosed with 150 ppm of the thermally-treated s,s,s-tributyl phosphorothioate as described in Example 5.

TABLE 1

| feedstock | coking rate, mg/min |
|---|---|
| No coke inhibitor | 0.050 |
| with 150 ppm the thermally-treated s,s,s-tributyl phosphorothioate | 0.036 |

As the data indicate, thermally-treated s,s,s-tributyl phosphorothioate is an effective coke inhibitor in terms of asymptotic coking rate reduction.

EXAMPLE 8

FIG. 4 shows an injector apparatus using high temperature steam as the heating media to convert phosphorous-sulfur compounds to thermally-treated phosphorous-sulfur compounds. In this apparatus, the heater is a tube-in-tube heat exchanger. A phosphorous-sulfur compound is injected into the inner tube d1, and steam flows in the annular space between the inner d1 and the outer tube d2. The phosphorous-sulfur compound is heated by the steam and converted to the thermally-treated phosphorous-sulfur compound while both the phosphorous-sulfur compound and steam move down the line. At the end of the inner tube, the steam and the thermally-treated phosphorous-sulfur compound flows meet and mix, and the steam serves as carrier thereafter. The thermally-treated phosphorous-sulfur compound/steam mixture proceeds to the injector. At the exit of the injector, the thermally-treated phosphorous-sulfur compound/steam mixture contact the feed in the pyrolysis furnace coil, and is dispersed in the feed.

EXAMPLE 9

FIG. 5 shows an injector apparatus using pyrolysis furnace coil as the heating device. In this case, the microthermal reactor is a piece of high alloy tubing which wraps around a hot pyrolysis furnace coil. The phosphorous-sulfur compound is heated using the heat from the pyrolysis furnace coil. The pyrolysis furnace coil at the crossover section (the transition piece from convection section to radiant section) is usually at a temperature around 1100° F., which is ideal for this purpose. After heating, the thermally-treated phosphorous-sulfur compound is mixed with a carrier and the mixture goes to the injector. The thermally-treated phosphorous-sulfur compound/carrier mixture discharges in the pyrolysis furnace, and comes in contact with the feed in the pyrolysis furnace coil.

EXAMPLE 10

FIG. 6 shows an injector apparatus using a pyrolysis furnace fire box as the heating device. The heating device is a piece of high alloy tubing which is located inside of the fire box of a pyrolysis furnace. The phosphorous-sulfur compound is heated as it flows through this piece tubing, and the resulting thermally-treated phosphorous-sulfur compound is mixed with a carrier. After the mixing, the thermally-treated phosphorous-sulfur compound/carrier mixture goes to the injector, and then into pyrolysis furnace.

EXAMPLE 11

FIG. 7 shows an injector apparatus which uses an electrical heater as the heating device and nitrogen as the carrier. The phosphorous-sulfur compound and carrier nitrogen are fed in through different lines, and they mix. The phosphorous-sulfur compound/nitrogen mixture is heated in a tube wrapped in the electrical heater. The electrical heater is a cylinder electrical heating furnace or heating tape. Upon exiting the heated tube, the resulting phosphorous-sulfur compound/nitrogen mixture goes to the injector, and at the exit of the injector, the additive/nitrogen mixture comes in contact with the feed in the pyrolysis furnace coil.

What is claimed is:

1. A method of inhibiting fouling of heat transfer surfaces in contact with petroleum or hydrocarbon feedstocks comprising heating a phosphorous-sulfur compound to yield a heat-treated phosphorous-sulfur compound exhibiting a $^{31}P$ NMR peak between about 93 and about 97 ppm; and thereafter contacting the heat transfer surfaces with the heat-treated phosphorous-sulfur compound.

2. The method of claim 1 wherein the fouling is coke formation in pyrolysis furnaces during thermal cracking of hydrocarbon feedstock.

3. The method of claim 1 wherein the heat-treated phosphorous-sulfur compound is prepared by heating a phosphorus-sulfur compound at a temperature of from about 160° C. to abut 500° C.

4. The method of claim 1 wherein the phosphorus-sulfur compound is selected from mono- or di-substituted thiophosphate esters, phosphorothioites, phosphorothioates and thiophosphonates.

5. The method of claim 4 wherein the phosphorus-sulfur compound is a trisubstituted phosphorothioate.

6. The method of claim 5 wherein the trisubstituted phosphorothioate is a s, s,s,s-trialkyl phosphorothioate.

7. The method of claim 6 wherein the s,s,s-trialkyl phosphorothioate is s,s,s-tributyl phosphorothioate.

8. The method of claim 1 wherein the phosphorus-sulfur compound is a mono- or di-substituted thiophosphate ester.

9. The method of claim 8 wherein the mono- or di-substituted substituted thiophosphate ester is a mono- or di-alkyl thiophosphate ester.

10. The method of claim 9 wherein the mono- or di-alkyl thiophophate ester is mono- or dioctyl thiophosphate ester or mono- or di(ethyl)hexyl thiophosphate ester.

11. The method of claim 1 wherein the heat treated phosphorous-sulfur compound is prepared by heating a phosphorus-sulfur compound at a temperature of from about 1800° to about 280° C.

12. The method of claim 1 wherein the heat-treated phosphorous-sulfur compound is prepared by heating a phosphorus-sulfur compound at a temperature of from about 200° to about 260° C.

13. The method of claim 1 wherein the phosphorous-sulfur compound is heated in an oxygen and water-free atmosphere.

14. The method of claim 2 comprising injecting the heat-treated phosphorous-sulfur compound into the pyrolysis furnace prior to processing the hydrocarbon feedstock.

15. The method of claim 14 wherein the heat-treated phosphorous-sulfur compound is injected into the pyrolysis furnace from about 30 minutes to about 24 hours prior to processing the hydrocarbon feedstock.

16. The method of claim 2 comprising injecting the heat-treated phosphorous-sulfur compound into the pyrolysis furnace simultaneously with hydrocarbon feedstock.

17. The method of claim 2 comprising injecting from about 1 to about 1000 ppm of the heat-treated phosphorus-sulfur compound into the pyrolysis furnace.

18. The method of claim 2 comprising injecting from about 10 to about 100 ppm of the heat-treated phosphorus-sulfur compound into the pyrolysis furnace.

19. A method of introducing a compound into a pyrolysis furnace coil comprising heating a phosphorous-sulfur compound at a temperature of from about 160° C. to 500° C. for about 5 minutes to about 3 hours to yield a heat-treated phosphorous-sulfur compound; and thereafter introducing the heat-treated phosphorous-sulfur compound into the pyrolysis furnace coil.

20. The method of claim 19 wherein the temperature ranges from about 200° C. to about 500° C.

21. The method of claim 19 further comprising mixing the phosphorous-sulfur compound or the heat-treated phosphorous sulfur compound with a carrier.

22. The method of claim 21 wherein the carrier is a gas or a liquid.

23. The method of claim 21 wherein the carrier is steam.

24. The method of claim 21 wherein the carrier is an inert gas.

25. The method of claim 21 wherein the carrier is nitrogen.

26. The method of claim 21 wherein the carrier is natural gas.

* * * * *